United States Patent [19]

Fleming et al.

[11] Patent Number: 4,526,318

[45] Date of Patent: Jul. 2, 1985

[54] PROPORTIONAL FLUID EXCHANGER AND RECIRCULATOR

[75] Inventors: Ted D. Fleming, Council Bluffs, Iowa; Dan A. Koch, Omaha, Nebr.; Francis R. McGill, Omaha, Nebr.; Ray P. Powers, Omaha, Nebr.; Roy H. Michaelsen, Ralston, Nebr.

[73] Assignees: Stephen T. McGill; Francis R. McGill, both of Omaha, Nebr.

[21] Appl. No.: 618,928

[22] Filed: Jun. 11, 1984

[51] Int. Cl.[3] ..... F24F 7/00

[52] U.S. Cl. ..... 236/49; 98/34.6; 137/597

[58] Field of Search ..... 236/49; 98/33 R, 32; 137/597, 596

[56] References Cited

U.S. PATENT DOCUMENTS

| | | | |
|---|---|---|---|
| 2,732,027 | 1/1956 | Wallin | 98/33 R |
| 3,246,643 | 4/1966 | Stark et al. | 126/110 |
| 3,367,258 | 2/1968 | Erfeling | 98/33 R |
| 3,691,928 | 9/1972 | Berg, Sr. et al. | 98/33 |
| 3,847,065 | 11/1974 | Holt et al. | 98/33 R |
| 4,079,665 | 3/1978 | Martin | 98/33 R |
| 4,249,461 | 2/1981 | Christenson et al. | 98/38 R |
| 4,336,748 | 6/1982 | Martin et al. | 98/33 A |

*Primary Examiner*—William E. Wayner

*Attorney, Agent, or Firm*—E. Robert Newman

[57] ABSTRACT

A proportional fluid exchanger and recirculator having a damper element pivoted at its approximate balance point for thermostatically-responsive proportioning of fluid within a mixing chamber. Said damper element supports actuator elements, thus permitting ready installation at jobsite.

19 Claims, 5 Drawing Figures

PROPORTIONAL FLUID EXCHANGER AND RECIRCULATOR

TECHNICAL FIELD

This invention relates generally to devices which exchange a fluid within an enclosure with a second fluid without the enclosure. Such devices provide for a total exchange, mere recirculation of the fluid within, or varying proportions of exchange and recirculation. The ventilation of an animal confinement facility is a typical application of the principles involved. More particularly the invention relates to devices which employ a pivoted damper, or valve, within a chamber which is located intermediate the two fluids so as to be able to communicate with both of them. The proportion of fluid exchanged and fluid recirculated is controlled through adjusting the pivotal position of the damper or valve.

BACKGROUND ART

The fluid exchanger of the present invention would have applications in many different contexts. An example is the ventilation, cooling and heating of industrial buildings which house heat-producing processes, such as laundry and dry cleaning plants. Often the standards of purity and temperature in chemical processing and food processing plants can be met or, at least abetted, with devices which apply the principles of the proportional fluid exchanger and recirculator of the present invention.

The problem which the embodiment of the present invention described herein was designed to solve was that of providing ventilation and acceptable temperature levels throughout all seasons in animal confinement buildings. The prior art includes devices which accomplish these goals in a generally satisfactory fashion. One such device is disclosed in U.S. Pat. No. 4,336,748 in which the damper consists of two blades which open and close in jaw-like fashion and are linked together by meshing gears. Some of the advantages of the present invention over the prior art include a single damper blade which may be counter-balanced about its pivot axis and a damper-mounted actuator which permits quicker, easier and less expensive installation.

DISCLOSURE OF THE INVENTION

In the embodiment disclosed herein, the invention is comprised of a housing having a generally rectangular cross-section which communicates with a confinement building, an injection duct and fan located in the upper front portion of the housing, an exhaust duct and fan located in the lower front portion of the housing, and a mixing chamber and damper mechanism located in the rear portion of the housing through which inlet and outlet openings may communicate with the injection and exhaust ducts, respectively. Also included are a nozzle structure mounted at the outlet of the injection duct and thermo-sensitive control means for setting the pivotal position of the damper and the fan speeds.

The damper is of a rectangular shape which is substantially equal to the inside section of the housing. The injection and exhaust ducts are created by a common wall which runs between opposing sides of the housing. The damper is supported by a sleeve, located near its mid-point, which pivots about an axle affixed to either interior side of the mixing chamber at points which are a distance away from the common wall of the injection duct and exhaust duct approximately equal to one-half the height of the mixing chamber. When the damper is set at the vertical position the fan functions to recirculate air within the confinement barn. In the horizontal position it will cause the fans to introduce maximum fresh air and eject an equivalent amount of warm stale air, and in intermediate positions it will cause a proportionate mix of these two functions.

By locating the damper actuator and the actuator drive motor on the damper itself and connecting the motor through chain and sprocket to the axle, it is possible to install the entire unit from within the building by merely affixing it to a prepared opening and connecting it to a power supply. In the prior art the actuator and drive motor are installed on the outside of the housing requiring considerable time and skill to affix them to the housing and then wire them to a power supply and temperature controllers after the housing and other components of the device are installed.

In the device of the present invention a perimeter flange on the front of the housing is affixed to an appropriately framed opening in the building. The installation of the entire unit from within the building is accomplished by moving it through the wall opening, securing the flange to the framing, hanging a control box within the building and providing a power connection. Wiring from the damper actuator drive, as well as the two fan motors and thermostats, all exit from the unit through a buss located at a point on the housing flange.

An additional advantage of locating the damper actuator and actuator drive on the damper near its pivot axis, is to minimize the amount of force required to reposition the damper, its weight being counterbalanced on both sides of the pivot axis. A bubble-shaped cover is provided for the actuator and actuator drive in order to reduce turbulance during summer months when outside air is being pulled across it.

Thus, the proportional fluid and recirculator of this invention has a substantially planar damper counterbalanced about a substantially centrally located pivot axis and, for purposes of installation, requires no wiring or reconstruction at jobsite.

These and other objects, advantages and novel features of the present invention will become apparent from the following detailed description of the invention when considered in conjunction with the accompanying drawings.

BEST MODE FOR CARRYING OUT THE INVENTION

Figure 1:
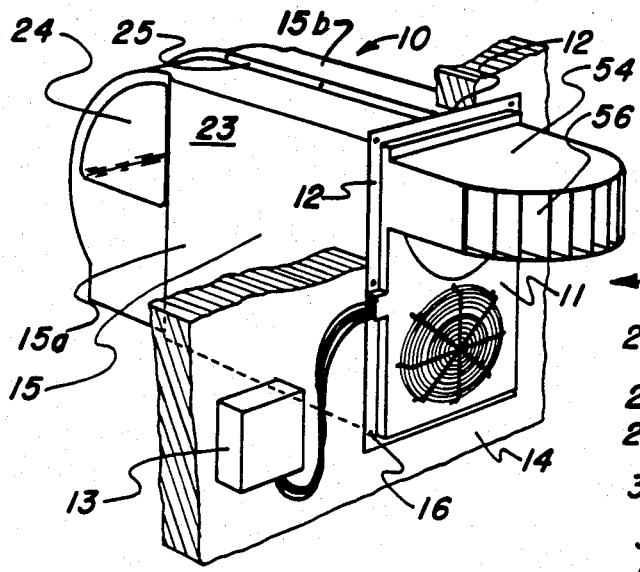
FIG. 1 is a perspective view of the invention shown installed in a confinement barn, its wall shown partially.

Referring now to the drawings wherein like reference numerals designate identical corresponding parts throughout the several views, and more particularly to FIG. 1, whereon the present invention is designated generally at 10, a removable face plate (11), a supporting flange (12), and a control box (13) are shown positioned on the interior of wall (14) of a confinement building (not shown). Housing (15) is shown positioned outside of the confinement building. For purposes of both installing the device (10) and having ready access to its interior at later times, face plate (11) is easily removed by means of fasteners (16) which are of conventional type. As can be better seen in FIG. 2, flange (12) abuts the interior wall (14) along the border of a preformed opening therein. As will be appreciated by those skilled in the art, ample support for the cantilevered weight of housing (15) and its contents can be obtained by conventional fastening means along the extent of flange (12).

Figure 2:
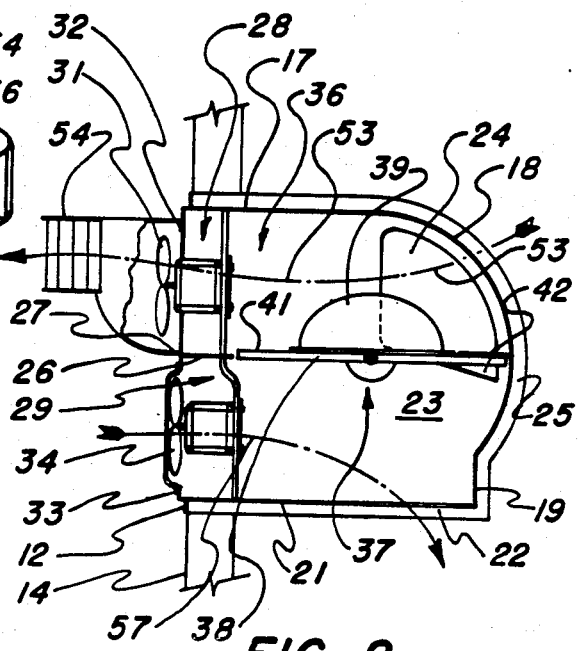
FIG. 2 is an elevational section of the invention showing its damper element in a horizontal orientation.

Still referring to FIG. 2, housing (15), is seen to be generally comprised of a rectangular planar top wall (17), a rectangular curving upper rear wall (18), a rectangular planar lower rear wall (19), a rectangular planar bottom wall (21) having a rearward opening (22), and two irregular planar side walls (23) each having a pie-shaped upper rearward opening (24) (see also FIG. 1). At the front portion of housing (15), adjacent to flange (12) is a rectangular planar horizontal dividing wall (26). Dividing wall (26) is positioned midway between top wall (17) and bottom wall (27) and is affixed at either end to the interior face of each side wall (23). Its position is such that its forward edge (27) will be in contact with the interior face of face plate (11) when said plate is fastened in place to flange (12). Dividing wall (26) forms a first duct, designated generally at (28), in the upper front portion of housing (15) and a second duct, designated generally at (29), in the lower front portion of housing (15).

First duct (28) will also be referred to herein as "injection duct (28)", since outside air will be pulled by fan blade (31) through openings (24) into first duct (28), and injected into the confinement barn through opening (32). Second duct (29) will be referred to herein as "exhaust duct (29)," since air inside of the confinement barn will be pulled through opening (33) by fan blade (34) into second duct (29) and then exhausted out of housing (15) through opening (22). That portion of housing (15) which is not formed into injection duct (28) and exhaust duct (29) by dividing wall (26) will be referred to hereinafter as the mixing chamber, designated generally at (36). It should also be noted that in the mode presented housing (15) is actually comprised of two mirror-image half-portions (15*a*) and (15*b*) which are conjoined along a vertically oriented flange (25) along the inner edge of each half-portion (15*a*) and (15*b*). This arrangement provides many efficiencies, which should be appreciated by those skilled in the art, in the manufacture and assemblage of housing (15) particularly relative to its being of an insulated sandwich construction.

Figure 4:
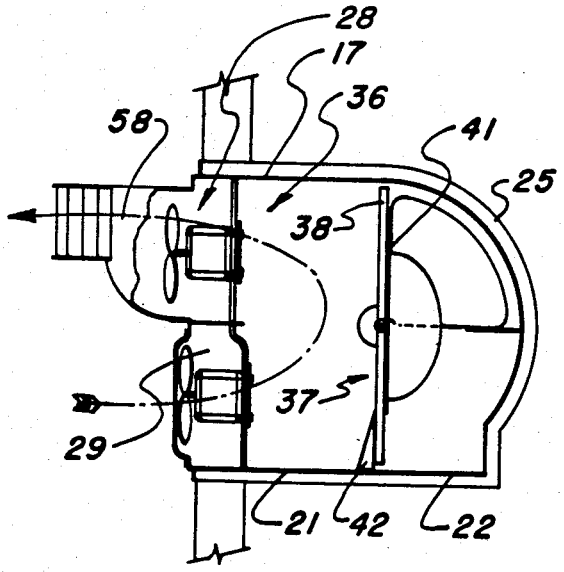
FIG. 4 is an elevational section of the invention showing its damper element in a vertical orientation.
Figure 5:
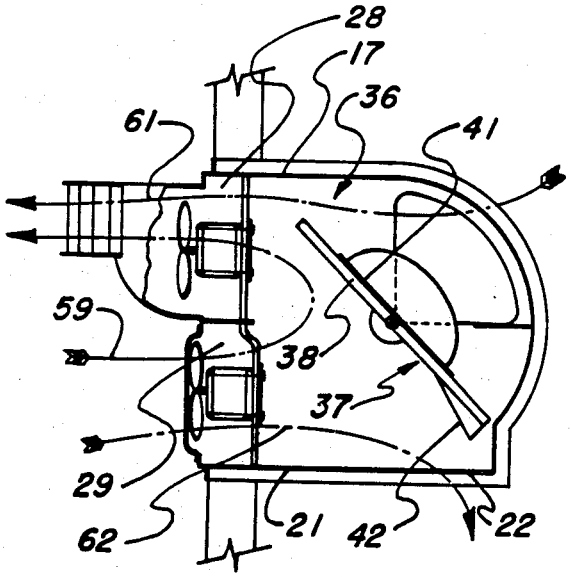
FIG. 5 is an elevational section of the invention showing its damper element in an intermediate orientation.

Referring now to FIGS. 4 and 5 as well as FIG. 2, it can be readily appreciated that the source of air injected into the confinement barn through injection duct (28) is not always air which enters through opening (24) into housing (15), and the air which is exhausted from the confinement barn through exhaust duct (29) is not always exhausted through opening (22). Sometimes the source of air injected into the confinement barn through injection duct (28) is that same air which has been exhausted from the confinement barn through exhaust duct (29) (see FIG. 4). At other times the air injected into the confinement barn is a combination of air entering from the outside through openings (24) and a portion of the air exhausted from the confinement barn through exhaust duct (29), the remaining portion thereof being exhausted through opening (22) (see FIG. 5). These different functions of device (10) are made possible by the presence of a damper assembly, designated generally at (37), within mixing chamber (36).

The main element of damper assembly (37) is a rectangular planar damper element (38) which is of a size slightly smaller than the interior vertical cross section of housing (15) between top wall (17) and bottom wall (21). It is pivotally mounted at its approximate midpoint between the interior face of each side wall (23). The mounting locations on side walls (23) are at points which are approximately equidistant from the nearest edge of dividing wall (26), top wall (17), and bottom wall (21). A removable bubble-shaped actuator and actuator drive motor cover (39) is removably affixed to the surface (41) of damper (38) which faces top wall (17) when damper (38) is oriented as in FIG. 2. The actuator and actuator drive motor (not shown in FIGS. 2, 4, and 5) are fixedly mounted to surface (41) within bubble (39) and a transmission mechanism (not shown in FIGS. 2, 4 and 5) connects the actuator drive to the pivotal mounting of damper (38). A position adjustable wedge-shaped deflector (42) is located rearward of the pivotal mounting and on the face of damper (38) opposite face (41) to complete the primary elements of damper assembly (37).

Figure 3:
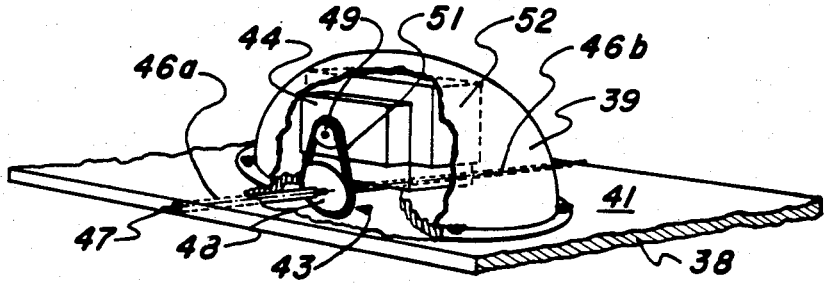
FIG. 3 is an enlarged partial perspective view of the damper assembly of the present invention.

Damper (38) is moved between the horizontal orientation seen in FIG. 2 and the vertical orientation seen in FIG. 4 into various intermediate orientations, an example of which may be seen in FIG. 5, through a transmission of power through transmission assembly, designated generally at (43), and actuator drive (44), these latter two elements being illustrated only in FIG. 3. To accomplish the pivotal mounting of damper element (38) to the interior faces of sidewalls (23), sleeves (46*a*) and (46*b*) are affixed within damper element (38) and cylindrical support axle (47), which bears within said sleeves (46*a*) and (46*b*), is affixed at its ends to the interior faces of walls (23). Transmission assembly (43) includes the following elements: a large sprocket (48) which is concentrically affixed to support axle (47) between sleeve (46*a*) and sleeve (46*b*), small sprocket (49) which is affixed to the drive shaft of actuator drive (44) and located so as to be coplanar with large sprocket (48), and sprocket chain (51). When actuator drive (44) rotates, damper element (38) must rotate about its pivotal mounting, since large sprocket (48) is fixed with respect to housing (15) through support axle (47) and side walls (23).

In operation the actual position of damper (38) is automatically controlled by an electronic proportional control thermostat (not shown) such as the series TP-8100 manufactured by the Barber Colman Company, located adjacent to the exhaust fan (28). As is well known to those knowledgeable in environmental control devices, the actuator (52) can cause damper element (38) to rotate to positions either admitting or closing off outside air from the interior of the confinement building for temperature settings ranging between approximately 50° and 100° Fahrenheit and in response to ambient temperature variations between minus 40° and plus 140° Farenheit.

To further assist in maintaining desirable temperature within the confinement barn a second electronic proportional control thermostat (not shown) is also located adjacent the exhaust fan (28). This second thermostat controls the speeds of fan blades (31) and (34), causing them to operate at a slower speed during cold winter periods and a higher speed during extremely hot periods.

It is only during periods of temperature extremes that damper (38) is actually in either of the two positions depicted in FIG. 2 and FIG. 4. During the vast majority of time an an intermediate position such as that seen in FIG. 5, is representative of the orientation of damper (38). FIG. 2 represents the orientation of damper (38) for maximum cooling. Arrow (53) therein indicates the direction of cooler outside air entering through opening (24), then traveling through mixing chamber (36), then through first duct (28), and finally being injected into the confinement barn through nozzle (54). As can be better seen in FIG. 1, nozzle (54) has a series of vanes (56) which can be adjusted so as to optimize the dispersion throughout the confinement barn regardless of the location of fluid exchanger (10) and the interior configuration of the barn. Arrow (57) represents the direction of warmer air which is exhausted through second duct (29), then mixing chamber (36), and finally through opening (22) when damper element (38) is oriented as seen in FIG. 2.

Referring now to FIG. 4, arrow (58) indicates the direction of air traveling through the fluid exchanger (10) when damper element (38) is oriented vertically for the purpose of achieving maximum recirculation and minimum introduction of outside air. This condition is representative of the coldest winter periods. Note that damper element (38) does not quite contact upper wall (17) of housing (15), fluid exchanger (10) being so efficient that it is always possible to admit a slight amount of fresh air even during the coldest periods. Also note that deflector (42) is shown in a position which causes damper element (38) to be slightly lengthened in the lower part of mixing chamber (36). This flexibility in the length of damper element (38) is achieved through the use of vertical slots (not shown) within deflector (42) through which bolts affixed to damper element (38) are positioned, thus allowing the adjustable positioning of deflector (42) thereon. In the orientation of deflector (42) and damper element (38) shown in FIG. 4, a slightly positive pressure would be created within the confinement barn.

Typical of the most frequently experienced combination of animal heat produced within the interior of the confinement barn and ambient outside temperatures is the orientation of damper element (38) seen in FIG. 5. Arrow (59) therein indicates that a portion of the air being injected within the confinement barn originates therewithin and is being recirculated. Arrow (61) indicates that a portion of the injected air originates from without the confinement barn and enters through opening (24). Arrow (62) indicates that a portion of the warm stale air within the confinement barn is exhausted to the outside. Thus, proportional fluid exchanger and recirculator (10) will control humidity, odor, and gases, as well as conserve energy and maintain a generally constant temperature throughout the year. It eliminates the need for refrigerated air in most situations and greatly reduces any requirement for supplementary heat.

It is believed that all of the advantages and objects mentioned above are accomplished by use of the best mode for carrying out the invention disclosed herein. Obviously, many modifications and variations of the present invention are possible in light of the above teachings. It is therefore to be understood that, within the scope of the appended claims, the invention may be practiced otherwise than as specifically described.

We claim:

1. A fluid exchanger, comprising:

a first duct of rectangular section for introducing a fluid into a substantially enclosed space;

a second duct of rectangular section for withdrawing fluid from said space and having one edge of its exhaust opening in common with one edge of the intake opening of the first duct;

means for moving fluid through said first and second ducts;

chamber means of rectangular section, open on opposite ends, a first open end thereof contiguous with the intake and exhaust openings of said first and second ducts which have an edge in common;

damper means of a size and shape substantially equal to the section of the chamber means, pivotally mounted within said chamber means about an axis oriented parallel with the common edge of said first and second ducts and located a distance away therefrom substantially equal to the distance it is away from a wall of the chamber means which is contiguous with the wall of the first duct which is opposite its edge in common with the second duct; and means for selectively pivoting said damper means from a position in which an edge of said damper means is adjacent the wall of the chamber means which is contiguous with the wall of the first duct which is opposite its edge in common with the second duct and which closes off the second open end of the chamber means to and in the direction of a position in which, said edge of said damper means is adjacent to the common edge of the exhaust and intake openings of the first and second ducts.

2. The fluid exchanger as set forth in claim 1, wherein the portions of the damper means on either side of its pivoting axis are substantially equal in weight to each other, whereby the maximum force required to pivot it is minimized.

3. A fluid exchanger, comprising:

a first duct of rectangular section for introducing a fluid into a substantially enclosed space;

a second duct of rectangular section for withdrawing fluid from said space and having one edge of its exhaust opening in common with one edge of the intake opening of the first duct;

means for moving fluid through said first and second ducts;

chamber means of rectangular section, open on opposite ends, a first open end thereof contiguous with the intake and exhaust openings of said first and second ducts which have an edge in common;

damper means of a size and shape substantially equal to the section of the chamber means, pivotally mounted within said chamber means about an axis oriented parallel with the common edge of said first and second ducts and located a distance away therefrom substantially equal to the distance it is away from a wall of the chamber means which is contiguous with the wall of the first duct which is opposite its edge in common with the second duct; and means for selectively pivoting said damper means to positions including and intermediate between one closing off the second open end of the chamber means to one in which an edge of said damper means contacts the common edge of the exhaust and intake openings of the first and second ducts, wherein said selectively pivoting means includes rotary power means connected by transmission means to the pivotal mounting of the damper means, said selectively pivoting means and said transmission means both mounted on the damper means.

4. The fluid exchanger as set forth in claim 3, wherein said selectively pivoting means and said transmission means are mounted on the face of the damper means which is towards the second open end of the chamber means when the damper means is oriented so as to close it off.

5. The fluid exchanger as set forth in claim 4, wherein said damper means includes deflector means mounted on the face of that portion of the damper means which is opposite the second duct when the damper means is oriented to close off the second open end of the chamber means and mounted at obtuse angle with respect to the remaining portion of the damper means.

6. The fluid exchanger as set forth in claim 3, further comprising counterbalancing means sufficient to make the portions of the total weight of the damper means and those elements mounted thereon either side of the pivoting axis substantially equal to each other, whereby the maximum force required to pivot them is minimized.

7. The fluid exchanger as set forth in claim 6, wherein said selectively pivoting means further includes means for automatically controlling the position of the damper means which is responsive to the temperature of the fluid entering the second duct.

8. The fluid exchanger as set forth in claim 7, wherein said damper means includes deflector means mounted on the face of that portion of the damper means which is opposite the second duct when the damper means is oriented to close off the second open end of the chamber means and mounted at obtuse angle with respect to the remaining portion of the damper means.

9. The fluid exchanger as set forth in claim 8, wherein said damper means further includes a bubble-shaped cover means mounted over the selectively pivoting means, whereby fluid turbulence will be minimized.

10. The fluid exchanger as set forth in claim 7, wherein said damper means further includes a bubble-shaped cover means mounted over the selectively pivoting means, whereby fluid turbulence will be minimized.

11. The fluid exchanger as set forth in claim 6, wherein said damper means includes deflector means mounted on the face of that portion of the damper means which is opposite the second duct when the damper means is oriented to close off the second open end of the chamber means and mounted at obtuse angle with respect to the remaining portion of the damper means.

12. The fluid exchanger as set forth in claim 11, wherein said damper means further includes a bubble-shaped cover means mounted over the selectively pivoting means, whereby fluid turbulence will be minimized.

13. The fluid exchanger as set forth in claim 6, wherein said damper means further includes a bubble-shaped cover means mounted over the selectively pivoting means, whereby fluid turbulence will be minimized.

14. The fluid exchanger as set forth in claim 3, wherein said selectively pivoting means further includes means for automatically controlling the position of the damper means which is responsive to the temperature of the fluid entering the second duct.

15. The fluid exchanger as set forth in claim 14, wherein said damper means includes deflector means mounted on the face of that portion of the damper means which is opposite the second duct when the damper means is oriented to close off the second open end of the chamber means and mounted at obtuse angle with respect to the remaining portion of the damper means.

16. The fluid exchanger as set forth in claim 3, wherein said damper means includes deflector means mounted on the face of that portion of the damper means which is opposite the second duct when the damper means is oriented to close off the second open end of the chamber means and mounted at obtuse angle with respect to the remaining portion of the damper means.

17. A fluid exchanger, comprising:

A first duct of rectangular section for introducing a fluid into a substantially enclosed space;

a second duct of rectangular section for withdrawing fluid from said space and having one edge of its exhaust opening in common with one edge of the intake opening of the first duct;

means for moving fluid through said first and second ducts;

chamber means of rectangular section, open on opposite ends, a first open end thereof contiguous with the intake and exhaust openings of said first and second ducts which have an edge in common;

damper means of a size and shape substantially equal to the section of the chamber means, pivotally mounted within said chamber means about an axis oriented parallel with the common edge of said first and second ducts and located a distance away therefrom substantially equal to the distance it is away from a wall of the chamber means which is contiguous with the wall of the first duct which is opposite its edge in common with the second duct; and means for selectively pivoting said damper means to positions including and intermediate between one closing off the second open end of the chamber means to one in which an edge of said damper means contacts the common edge of the exhaust and intake openings of the first and second ducts; wherein said damper means includes deflector means mounted on the face of that portion of the damper means which is opposite the second duct when the damper means is oriented to close off the second open end of the chamber means and mounted at an obtuse angle with respect to the remaining portion of the damper means.

18. A fluid exchanger, comprising:

first duct of rectangular section for introducing a fluid into a substantially enclosed space;

a second duct of rectangular section for withdrawing fluid from said space and having one edge of its exhaust opening in common with one edge of the intake opening of the first duct;

means for moving fluid through said first and second ducts;

chamber means of rectangular section, open on opposite ends, a first open end thereof contiguous with the intake and exhaust openings of said first and second ducts which have an edge in common;

damper means of a size and shape substantially equal to the section of the chamber means, pivotally mounted within said chamber means about an axis oriented parallel with the common edge of said first and second ducts and located a distance away therefrom substantially equal to the distance it is away from a wall of the chamber means which is contiguous with the wall of the first duct which is opposite its edge in common with the second duct, wherein the portions of the damper means on either side of its pivoting axis are substantially equal in weight to each other; and means for selectively pivoting said damper means to positions including and intermediate between one closing off the second open end of the chamber means to one in which an edge of said damper means contacts the common edge of the exhaust and intake openings of the first and second ducts, wherein said damper means includes deflector means mounted on the face of that portion of the damper means which is opposite the second duct when the open end of the chamber means and mounted at obtuse angle with respect to the remaining portion of the damper means.

19. A fluid exchanger, comprising:

a first duct of rectangular section for introducing a fluid into a substantially enclosed space;

a second duct of rectangular section for withdrawing fluid from said space and having one edge of its exhaust opening in common with one edge of the intake opening of the first duct;

means for moving fluid through said first and second ducts;

chamber means of rectangular section having a first opening contiguous with the intake and exhaust openings of said first and second ducts which have an edge in common, having a second opening for receiving the fluid which said first duct will introduce into said space, and having a third opening for exhausting the fluid which said second duct has withdrawn from said space;

damper means pivotally mounted within said chamber means about an axis oriented parallel with the common edges of said first and second ducts; and means for selectively pivoting said damper means to positions including and intermediate between one closing off the second and third openings of the chamber means and one in which an edge of said damper means contacts the common edge of the exhaust and intake openings of the first and second ducts, said selectively pivoting means including rotary power means connected by transmission means to the pivotal mounting of the damper means and said selectively pivoting means and said transmission means both mounted on said damper means.

* * * * *